US005702086A

United States Patent [19]

Hunt

[11] Patent Number: 5,702,086

[45] Date of Patent: Dec. 30, 1997

[54] PORTABLE TREE HOLDING DEVICE

[76] Inventor: Randy D. Hunt, 20780 Armstrong P.O. Box 81, Laton, Calif. 93242

[21] Appl. No.: 643,832

[22] Filed: May 7, 1996

[51] Int. Cl.[6] ..... F16M 13/00

[52] U.S. Cl. ..... 248/519; 47/40.5; 248/527; 280/28.12; 280/845

[58] Field of Search ..... 248/519, 523, 248/524, 527, 128; 280/845, 28.12; 47/40.5

[56] References Cited

U.S. PATENT DOCUMENTS

| | | | |
|---|---|---|---|
| 1,662,091 | 3/1928 | Vuozzo | 248/524 |
| 1,766,170 | 6/1930 | Goldwood | 248/527 |
| 1,914,150 | 6/1933 | Muldoon | 248/527 X |
| 4,331,341 | 5/1982 | McKeown | 280/845 X |
| 4,730,569 | 3/1988 | Colson | 280/28.12 X |
| 5,118,067 | 6/1992 | Gillanders | 248/527 |
| 5,299,381 | 4/1994 | Oldenburg, Jr. | 248/527 X |
| 5,388,799 | 2/1995 | Keefe | 248/519 |
| 5,425,547 | 6/1995 | Payan | 248/527 X |
| 5,575,490 | 11/1996 | Simpson, Jr. | 280/28.12 |

FOREIGN PATENT DOCUMENTS

| | | | |
|---|---|---|---|
| 62987 | 2/1913 | Switzerland | 280/845 |

*Primary Examiner*—Ramon O. Ramirez
*Assistant Examiner*—Derek J. Berger

[57] ABSTRACT

A new Portable Tree Holding Device for creatively and innovatively holding a Christmas tree or the like in a vertical upright position. The inventive device includes a snow sled with runners, a water cup, a cup support supported by a support base, and sled boards with internal arcuate ends and internal arcuate sides. An object of the present invention is to provide a new Portable Tree Holding Device that is capable of watering the tree to keep it fresh while providing a clever, new, ornamental look.

10 Claims, 3 Drawing Sheets

PORTABLE TREE HOLDING DEVICE

BACKGROUND OF THE INVENTION

1. Field of the Invention

The present invention relates to display stands and more particularly pertains to a new Portable Tree Holding Device for creatively and innovatively holding a Christmas tree or the like in a vertical upright position.

2. Description of the Prior Art

The use of display stands is known in the prior art. More specifically, display stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art display stands include U.S. Pat. No. 5,350,149 issued to Evans Jr. et al. on 27 Sep. 1994; U.S. Pat. No. 5,209,450 issued to Grapes on 11 May 1993; U.S. Pat. No. 4,076,205 issued to Almer et al. on 28 Feb. 1978; U.S. Patent Des. 318,825 issued to Dunbar on 6 Aug. 1991; U.S. Patent Des. 319,806 issued to Schmid on 10 Sep. 1991, and U.S. Patent Des. 309,123 issued to Brooks on 10 Jul. 1990.

While these devices fulfill their respective, particular objectives and requirements, the aforementioned patents do not disclose a new Portable Tree Holding Device. The inventive device includes a snow sled with runners, a water cup, a cup support supported by a support base, and sled boards with internal arcuate ends and internal arcuate sides.

In these respects, the Portable Tree Holding Device according to the present invention substantially departs from the conventional concepts and designs of the prior art, and in so doing provides an apparatus primarily developed for the purpose of creatively and innovatively holding a Christmas tree or the like in a vertical upright position.

SUMMARY OF THE INVENTION

In view of the foregoing disadvantages inherent in the known types of display stands now present in the prior art, the present invention provides a new Portable Tree Holding Device construction wherein the same can be utilized for creatively and innovatively holding a Christmas tree or the like in a vertical upright position.

The general purpose of the present invention, which will be described subsequently in greater detail, is to provide a new Portable Tree Holding Device apparatus and method which has many of the advantages of the display stands mentioned heretofore and many novel features that result in a new Portable Tree Holding Device which is not anticipated, rendered obvious, suggested, or even implied by any of the prior art display stands, either alone or in any combination thereof.

To attain this, the present invention generally comprises a snow sled with runners, a water cup, a cup support supported by a support base, and sled boards with internal arcuate ends and internal arcuate sides.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Portable Tree Holding Device apparatus and method which has many of the advantages of the display stands mentioned heretofore and many novel features that result in a new Portable Tree Holding Device which is not anticipated, rendered obvious, suggested, or even implied by any of the prior art display stands, either alone or in any combination thereof.

It is another object of the present invention to provide a new Portable Tree Holding Device which may be easily and efficiently manufactured and marketed.

It is a further object of the present invention to provide a new Portable Tree Holding Device which is of a durable and reliable construction.

An even further object of the present invention is to provide a new Portable Tree Holding Device which is susceptible of a low cost of manufacture with regard to both materials and labor, and which accordingly is then susceptible of low prices of sale to the consuming public, thereby making such Portable Tree Holding Device economically available to the buying public.

Still yet another object of the present invention is to provide a new Portable Tree Holding Device which provides in the apparatuses and methods of the prior art some of the advantages thereof, while simultaneously overcoming some of the disadvantages normally associated therewith.

Still another object of the present invention is to provide a new Portable Tree Holding Device for creatively and innovatively holding a Christmas tree or the like in a vertical upright position.

Yet another object of the present invention is to provide a new Portable Tree Holding Device which includes a snow sled with runners, a water cup, a cup support supported by a support base, and sled boards with internal arcuate ends and internal arcuate sides.

Still yet another object of the present invention is to provide a new Portable Tree Holding Device that is useful for transporting the loaded tree.

Even still another object of the present invention is to provide a new Portable Tree Holding Device that is capable of watering the tree to keep it fresh while providing a clever, new, ornamental look.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
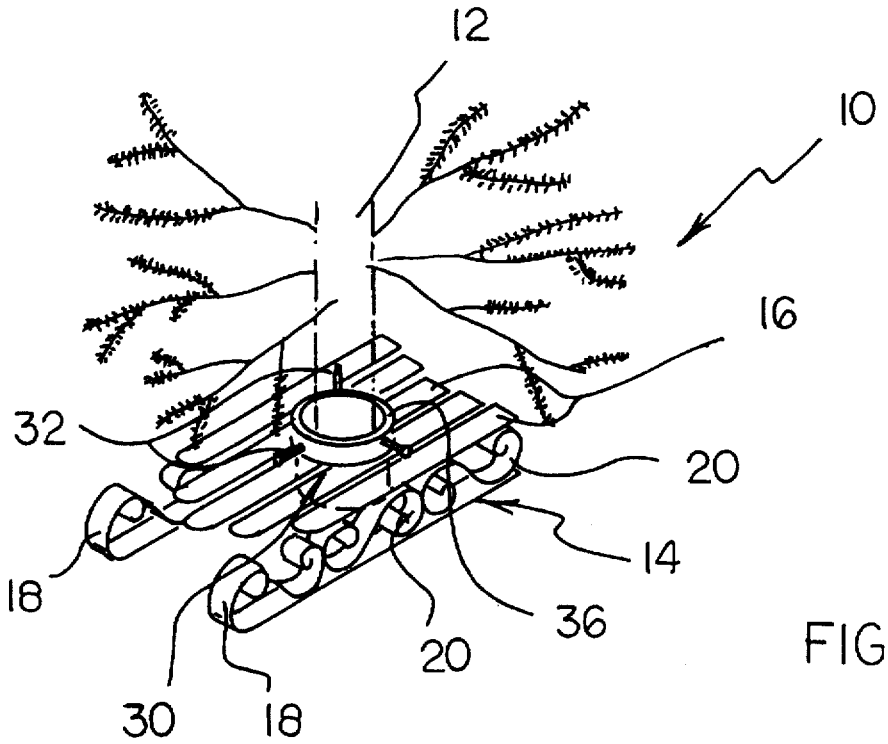
FIG. 1 is a right side perspective view of a new Portable Tree Holding Device according to the present invention.
Figure 2:
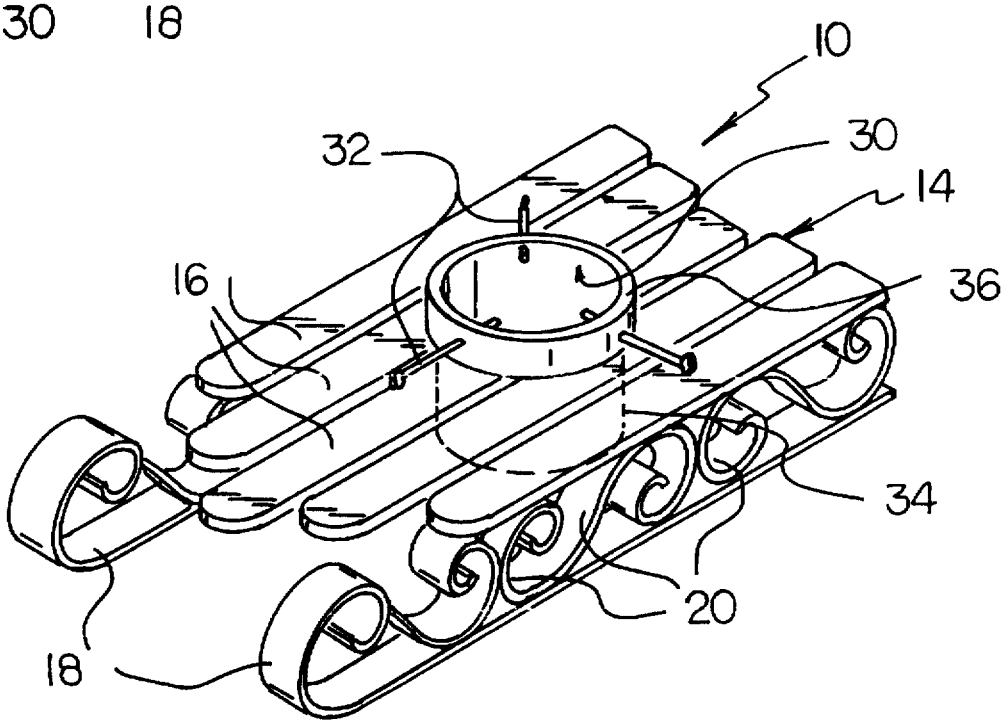
FIG. 2 is an enlarged right side perspective view thereof.
Figure 3:
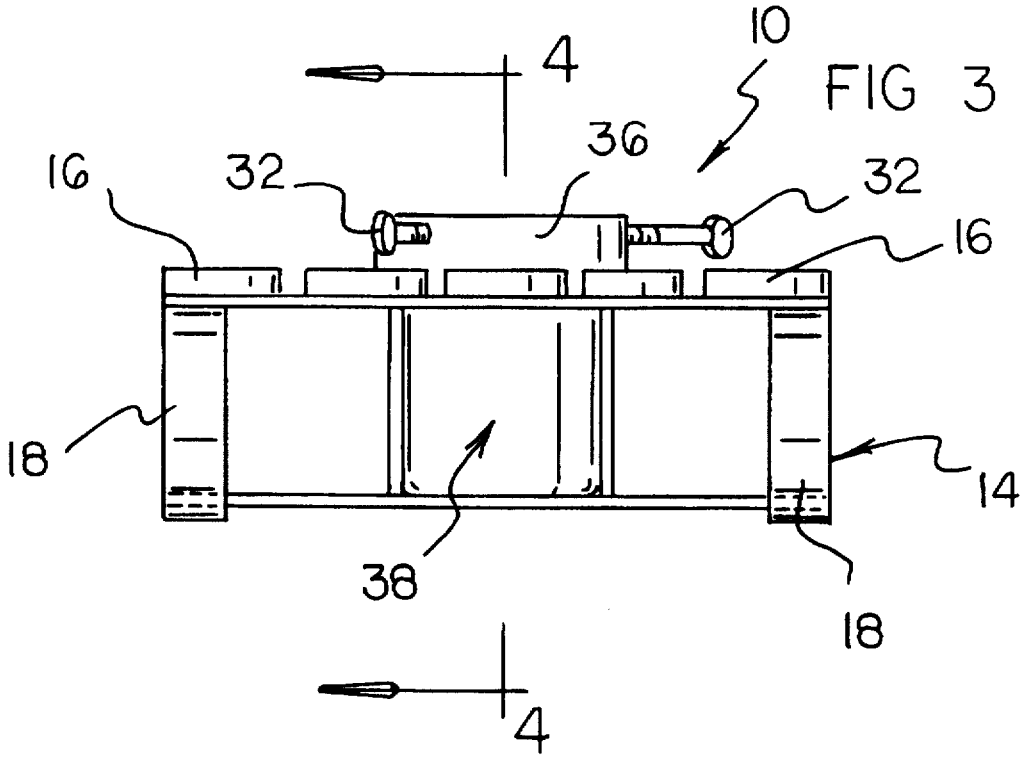
FIG. 3 is an enlarged rear elevation view thereof.
Figure 4:
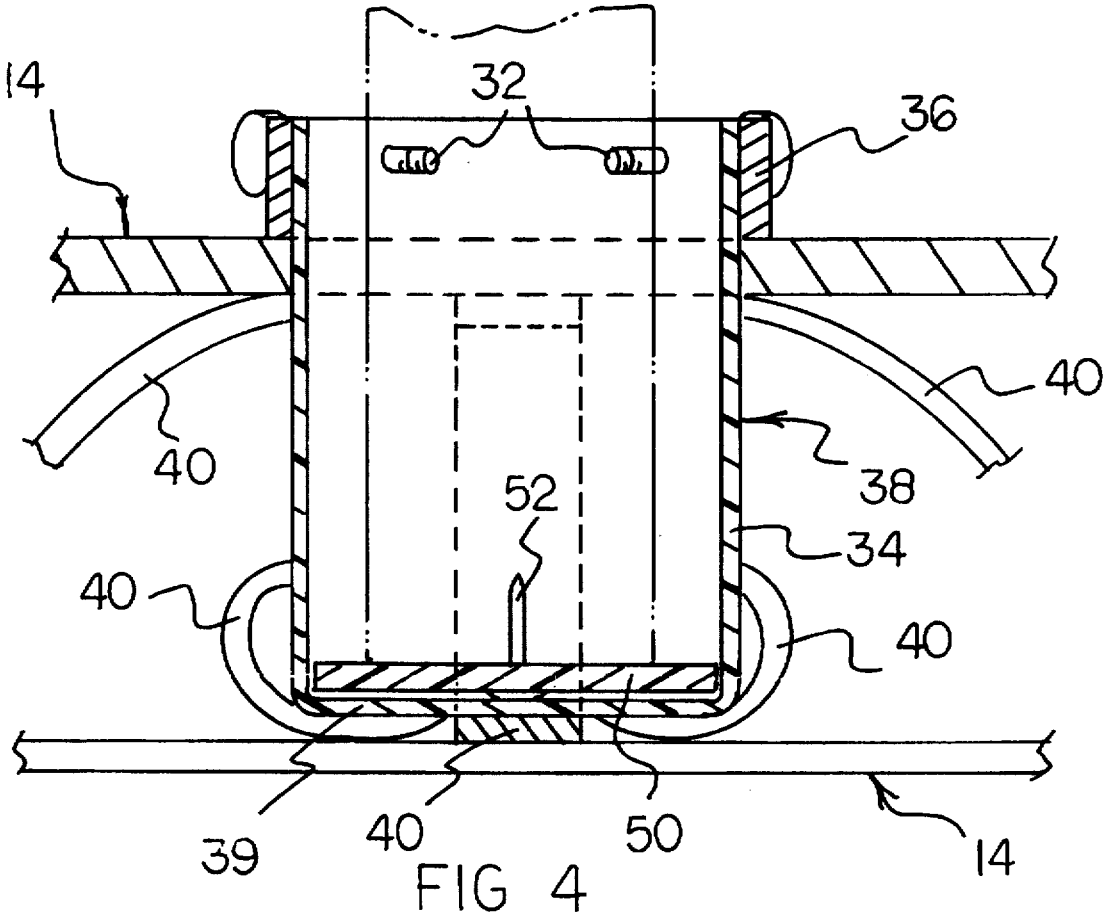
FIG. 4 is a cross sectional view taken along line 4—4 of FIG. 3.
Figure 5:
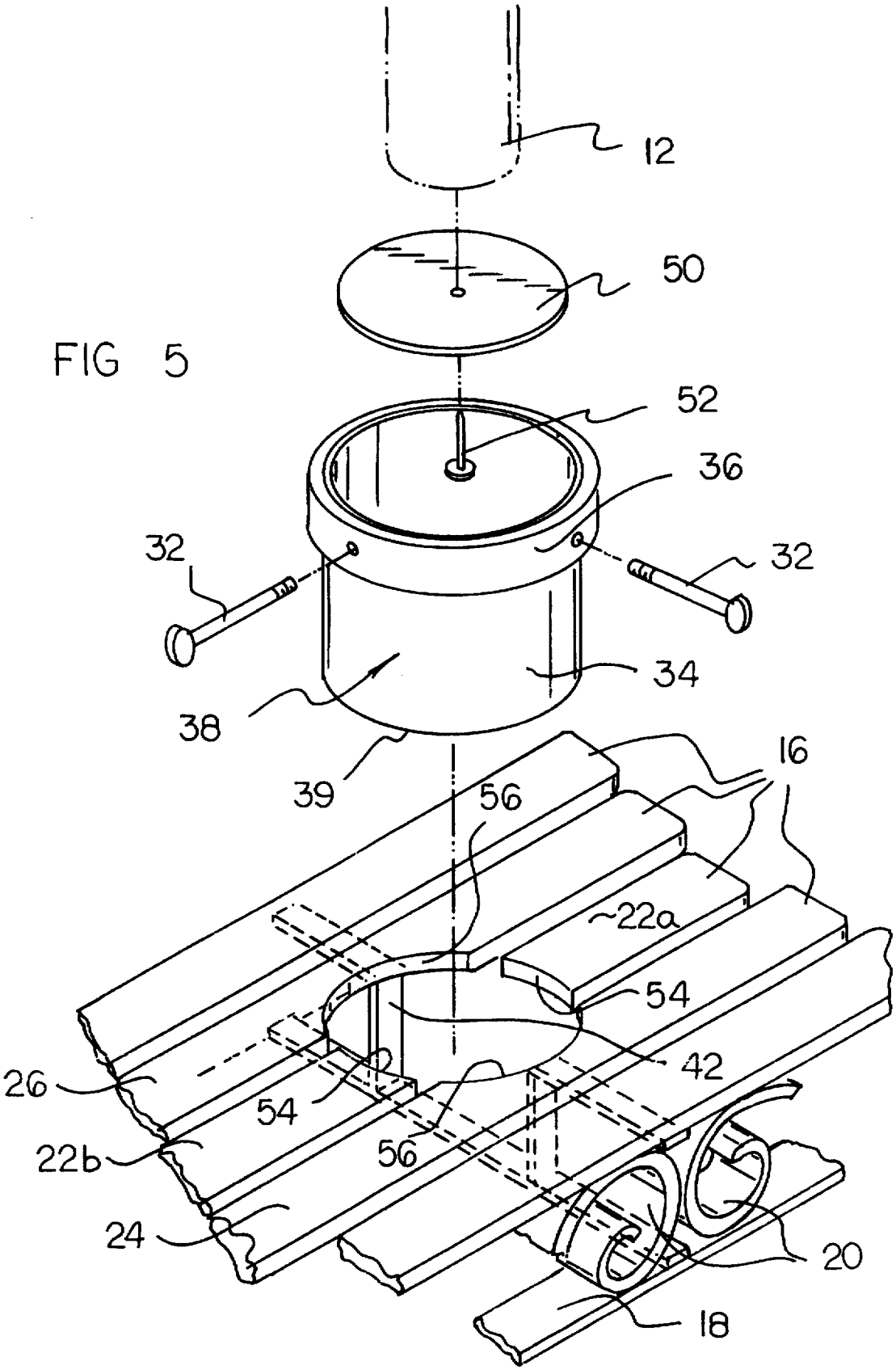
FIG. 5 is an enlarged exploded isometric illustration of the present invention.

With reference now to the drawings, and in particular to FIGS. 1 through 5 thereof, a new Portable Tree Holding Device embodying the principles and concepts of the present invention and generally designated by the reference numeral 10 will be described.

More specifically, it will be noted that the Portable Tree Holding Device 10 comprises a snow sled stand 14 with sled runners 18, a water cup 38, a cup support 40 supported by a support brace 42, and sled boards 16 with internal arcuate ends 54 and internal arcuate sides 56.

As best illustrated in FIGS. 1 through 5, it can be shown that the snow sled stand 14 is comprised of sled runners 18, which are fastened to the sled boards 16, by vertical supports 20. In a five board design, three inner boards including a center board 22, a hole left side board 24, a hole right side board 26, work together to define an aperture for a water cup 38. The center board 22 is further comprised of a rear center board **22*a* and a front center board 22*b*, each having an internal arcuate end 54, the hole left side board 24 and the hole right side board 26, each have an internal arcuate side 56. The water cup 38 is supported by a cup support 40 supported by a support brace 42**.

A Christmas tree 12, or the like, is held in a vertical position by a tree base 30, which is comprised of the water cup 38, where the water cup 38 is further defined as being comprised of a base tube 34 which forms a vertical wall that encompasses the Christmas tree 12. At the lower end of the base tube 34, there is a cup bottom 39, wherein the tube base 34 and the cup bottom 39 work together to form the water cup 38. At the upper end of the base tube 34, there is a base support rib 36, which includes a plurality of base tighteners 32.

The bottom end of the Christmas tree is held in substantially concentric relationship to the cup bottom 39, by a tree base plate 50 which is attached to the Christmas tree 12 by a base plate retainer 52.

In use, the tree base plate 50, is attached to the Christmas tree 12 by a base plate retainer 52. The Christmas tree is then placed in the upright vertical position into the water cup 38 and is fixed to satisfaction by the base tighteners 32. The tree can then be slid across the snow or the ground as may be desirable to avoid lifting, and placed on display at a desirable location. The water cup is then filled to an appropriate level to keep the tree as fresh as possible. Lastly, the tree is decorated, and no skirt for appearance sake, is required.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Portable Tree Holding Device comprising:

a snow sled stand with sled runners, a water cup, a cup support supported by a support brace, and sled boards each having internal arcuate ends and internal arcuate sides;

wherein the sled runners are fastened to the sled boards by vertical supports;

wherein the sled boards further include a center board, a hole left side board, a hole right side board which collectively define an aperture for receiving the water cup;

wherein the center board further comprises a rear center board and a front center board each having an arcuate end portion for defining said aperture and wherein the hole left side board and the hole right side board each have an arcuate side portion for defining said aperture;

wherein the water cup comprises a base tube forming a vertical wall for surrounding the lower end of a tree trunk;

wherein the lower end of the base tube further comprises a cup bottom mounted to the tube base; and wherein the base tube includes an upper end and a base support rib and a plurality of base tighteners rotatably mounted in said upper end for advancing into abutment with a tree trunk inserted into said base tube.

2. The Portable Tree Holding Device of claim 1, additionally comprising a tree base plate adapted to be attached to the lower portion of a tree trunk by a base plate retainer, said tree base plate having a size and size adapted to be inserted in said base tube.

3. A portable tree holding device comprising:

a tree transport apparatus for transporting a tree along the ground, said transport apparatus comprising a substantially planar platform;

a pair of sled runners mounted to said platform for supporting said platform in an elevated condition above the ground; and a tree trunk mounting means for supporting a tree on said platform in a substantially vertical orientation and comprising a mounting cup removably mountable to the trunk of a tree to be transported on said transport apparatus, said mounting cup being mounted on said platform for removability of said cup from said platform in an upwards direction without requiring removal of said mounting cup from the trunk of a tree.

4. The portable tree holding device of claim 3 wherein said platform comprises a plurality of elongate parallel board members.

5. The portable tree holding device of claim 3 wherein said platform includes an aperture for removably receiving said mounting cup.

6. The portable tree holding device of claim 5 wherein said mounting cup comprises a substantially cylindrical base tube with an open upper end and a closed lower end and an annular collar protruding from the rim of said open upper end, wherein the diameter of said base tube is smaller than the diameter of the aperture in said platform and the diameter of said annular collar is larger than the diameter of the diameter of the aperture in said platform such that the platform is capable of supporting said mounting cup at its annular collar.

7. The portable tree holding device of claim 3 wherein said mounting cup comprises a substantially cylindrical base tube with an open upper end and a closed lower end, and additionally comprising a tree base plate for mounting on the end of a tree trunk, said base plate having a diameter being sufficiently small enough to fit in the interior of said cylindrical base tube and sufficiently large enough to restrict lateral movement of said base plate in said base tube, whereby a base plate mounted to the trunk of a tree mounted in said mounting cup restricts lateral movement of said tree trunk regardless of the difference in diameter between said tree trunk and the interior of said cylindrical base tube.

8. The portable tree holding device of claim 3 wherein said mounting cup additionally comprises at least three base tighteners threadedly mounted in the upper end of said mounting cup for rotatably advancing into abutment with a tree trunk inserted in said mounting cup.

9. The portable tree holding device of claim 3 additionally comprising a mounting cup support extending below said mounting cup such that said mounting cup rests upon said mounting cup support when said mounting cup is mounted on the platform of said transport apparatus.

10. The portable tree holding device of claim 3 additionally comprising vertical supports mounted between said platform and said sled runners.

* * * * *